United States Patent [19]

Shigemori et al.

[11] 4,410,831

[45] Oct. 18, 1983

[54] OVERVOLTAGE PROTECTING ELEMENT

[75] Inventors: Daizo Shigemori, Sagamihara; Yuji Muramatsu, Machida, both of Japan

[73] Assignee: Kabushiki Kaisha Sankosha, Tokyo, Japan

[21] Appl. No.: 333,613

[22] Filed: Dec. 22, 1981

[30] Foreign Application Priority Data

Jul. 28, 1981 [JP] Japan ..... 56-111846[U]

[51] Int. Cl.[3] ..... H01J 17/00; H01J 21/00

[52] U.S. Cl. ..... 313/325; 313/3

[58] Field of Search ..... 313/3, 231.1, 283, 313, 313/325, 326, 331, 306; 361/112, 120

[56] References Cited

U.S. PATENT DOCUMENTS

| | | | |
|---|---|---|---|
| 3,588,576 | 6/1971 | Kawiecki | 313/306 |
| 3,959,696 | 5/1976 | Lange et al. | 361/120 |
| 3,979,646 | 9/1976 | Peche et al. | 313/306 |
| 3,989,985 | 11/1976 | Lange et al. | 361/120 |
| 4,056,753 | 11/1977 | Keikichi et al. | 313/325 |
| 4,091,436 | 5/1978 | Lange et al. | 313/325 |
| 4,287,548 | 9/1981 | Hahndorff | 361/120 |

*Primary Examiner*—David K. Moore
*Assistant Examiner*—Robert E. Wise
*Attorney, Agent, or Firm*—Schwartz, Jeffery, Schwaab, Mack, Blumenthal & Koch

[57] ABSTRACT

An overvoltage protecting element of the invention has a pair of main electrodes, the discharging surfaces of which oppose each other with a gap therebetween in a cylindrical body of an insulator, and a conductive member which is formed on the inner wall surface of the cylindrical body to oppose the main electrodes with a gap therebetween, and a plurality of extended parts of which extending in the circumferential direction of the cylindrical body being connected in the axial direction of the cylindrical body. The main electrodes and the conductive member are electrically connected to each other by capacitive coupling.

7 Claims, 5 Drawing Figures

OVERVOLTAGE PROTECTING ELEMENT

BACKGROUND OF THE INVENTION

The present invention relates to an overvoltage protecting element and, more particularly, to an overvoltage protecting element of gas-filled discharge tube type.

Overvoltage protecting elements of gas-filled discharge tube type are widely used to protect power transmission lines and electric equipment connected thereto from high voltage surges. In an overvoltage protecting element of this type, upon application of a high voltage surge, the initiating time of discharge may be delayed, the firing potential at the initiating time of discharge may vary, or the dielectric breakdown of the overvoltage protecting element may be caused due to the decrease in the dielectric strength. When these phenomena occur, the equipment to be protected may not be protected from the high voltage surge.

Various proposals have been made in order to solve these problems. For example, in order to prevent time lag of the initiation of discharge upon application of a high voltage surge, U.S. Pat. No. 3,588,576 proposes to form a conductive layer of lumped potential gradient in the vicinity of the main electrodes for discharging the overvoltage protecting element. According to this prior art, when the high voltage surge is applied to the overvoltage protecting element, the lumped potential gradient is obtained at the vicinity of the main electrodes by the conductive layer, so that discharge between the main electrodes may be facilitated. The overvoltage protecting element of gas-filled discharge tube type disclosed in this U.S.P. specification comprises a hollow cylindrical body of an insulator such as ceramics or glass, a pair of main electrodes which are hermetically sealed to both opening ends of the cylindrical body to define a sealed chamber therebetween and discharging surfaces of which oppose each other with a gap therebetween within the cylindrical body, and an elongated conductive layer which extends in the ionization area of the gap in the axial direction of the cylindrical body along the inner wall surface thereof. According to this U.S.P. specification, when a high voltage surge is applied to the overvoltage protecting element, the electric field lines may be lumped between the end parts of the elongated conductive layer and the opposing electrodes to ionize the gas in the ionization area of the gap at a high speed, so that the discharge between the main electrodes may be started earlier. However, in the overvoltage protecting element described in this U.S.P. specification, when dicharge of large currents is caused frequently between a pair of main electrodes incorporated in the overvoltage protecting element, part of the material constituting the main electrodes sputters and becomes attached to the inner wall surface of the cylindrical body surrounding these main electrodes. Then, a thin conductive layer is formed on the inner wall surface of the cylindrical body to be connected to the elongated conductive layer, and the dielectric strength of the element may be degraded. Due to this sputtering, the firing potential between the main electrodes may decrease or become unstable.

As an improvement over this overvoltage protecting element, there is known an overvoltage protecting element disclosed in U.S. Pat. No. 4,056,753 of the applicant of the present invention. An overvoltage protecting element disclosed in this U.S.P. specification comprises a hollow cylindrical body of an insulator, a pair of main electrodes which are hermetically sealed to both opening ends of the cylindrical body to define a sealed chamber therebetween and discharging surfaces of which oppose each other with a gap therebetween, and two conductive layers which are formed in the circumferential direction of the cylindrical body along the inner wall surface of the cylindrical body to oppose the main electrodes with a gap therebetween and which respectively have, at least at part thereof, projections protruding toward the opposing main electrodes. In the overvoltage protecting element described in this U.S.P. specification, the conductive layers and the main electrodes are capacitively coupled, so that the connection of the conductive layers and resultant degradation in the dielectric strength may be eliminated. However, since the two conductive layers respectively have projections extending toward the opposing electrodes, the manufacturing process may become complex in procedure. In addition to this, the discharge may be concentrated at these projections at the initial period of discharge, resulting in a decrease in the firing potential between the main electrodes and variations in performance.

SUMMARY OF THE INVENTION

It is an object of the present invention to provide an overvoltge protecting element wherein there is no lag in the discharge initiating time.

It is another object of the present invention to provide an overvoltage protecting element wherein a decrease in the firing potential is prevented.

It is still another object of the present invention to provide an overvoltage protecting element wherein variations in discharge performance may be eliminated.

It is still another object of the present invention to provide an overvoltage protecting element wherein the effective operation time is long.

In order to achieve these and other objects, there is provided according to the present invention an overvoltage protecting element comprising a hollow cylindrical body of an insulating member; a pair of main electrodes which are hermetically sealed to both opening ends of said cylindrical body to define a sealed chamber therebetween and discharging surfaces of which oppose each other with a gap therebetween in said cylindrical body; and a conductive member having a plurality of extended parts and a connecting part, said extended parts extending along an inner wall surface of said cylindrical body in the circumferential direction thereof, to oppose said main electrodes with a gap therebetween, said extended parts being spaced apart from each other in the axial direction of said cylindrical body, and said connecting part extending along said inner wall surface to electrically connect said plurality of extended parts spaced apart in the axial direction of said cylindrical body.

DETAILED DESCRIPTION OF THE PREFERRED EMBODIMENTS

The preferred embodiments of the overvoltage protecting element of the present invention will now be described in detail with reference to the accompanying drawings.

Figure 1:
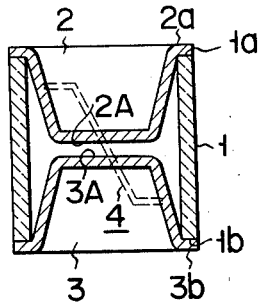
FIG. 1 is a schematic longitudinal sectional view showing the configuration of an overvoltage protecting element according to an embodiment of the present invention.
Figure 2:
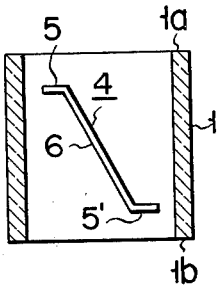
FIG. 2 is a schematic longitudinal sectional view showing the details of the conductive member shown in FIG. 1 with the main electrodes being removed.

FIG. 1 is a schematic longitudinal sectional view showing the configuration of an overvoltage protecting element according to an embodiment of the present invention. In the overvoltage protecting element shown in FIG. 1, a cylindrical body 1 comprises an insulating member of ceramics, glass or like. A pair of main electrodes 2 and 3 are hermetically sealed through rings 2*a* and 3*b*, respectively, to opening ends 1*a* and 1*b* of the cylindrical body 1 so that discharging surfaces 2A and 3A of the main electrodes 2 and 3 may oppose each other with a gap therebetween, defining a sealed chamber of gas-filled discharge tube type. A conductive member 4 is formed along the inner wall surface of the cylindrical body 1 by drawing a graphite core or application of a conductive paint so that the conductive member 4 may oppose the main electrodes 2 and 3 with a gap therebetween. The conductive member 4 has a plurality of extended parts, for example, extended parts 5 and 5', and a connecting part 6, as shown in FIG. 2. The extended parts 5 and 5' extend along the inner wall surface of the cylindrical body 1 in the cicumferential direction thereof to oppose the main electrodes 2 and 3 with a gap therebetween. The extended parts 5 and 5' are spaced apart from each other in the axial direction of the cylindrical body 1. The connecting part 6 is formed to extend along the inner wall surface of the cylindrical body 1 to electrically connect the extended parts 5 and 5' which are spaced apart from each other in the axial direction of the cylindrical body 1. The main electrodes 2 and 3 and the conductive member 4 oppose each other with a gap therebetween, defining a capacitor including the gas sealed in a gas-filled discharge tube as a dielectric substance and establishing capacitive coupling between the conductive member 4 and the main electrodes 2 and 3.

The mode of operation of the overvoltage protecting element of this embodiment of the present invention will now be described. When the voltage surge is applied across the main electrodes 2 and 3 in the overvoltage protecting element shown in FIG. 1, this voltage surge is simultaneously applied across the main electrode 2 and the conductive member 4 and across the main electrode 3 and the conductive member 4 due to the capacitive coupling between the conductive member 4 and the main electrodes 2 and 3. A substantially uniform electric field is induced between the main electrodes 2 and 3 when this voltage surge is applied. However, non-uniform electric fields are induced between the main electrode 2 and the conductive member 4 and between the main electrode 3 and the conductive member 4. Due to the presence of these non-uniform electric fields, ions and electrons are generated which are accumulated on the conductive member 4. Therefore, the conductive member 4 is highly charged and the ionization is further activated. As a result of this activated ionization, the discharge between the main electrodes 2 and 3 is facilitated and the discharge may thus be initiated earlier, and the time lag in the initiation of discharge between the main electrodes may be prevented.

In the overvoltage protecting element of the embodiment described above, when the voltage surge is applied several times across the main electrodes 2 and 3 under operative condition, and the discharge is repeated between the main electrodes 2 and 3, fine particles of the material constituting the electrodes are repeatedly sputtered and become attached to the conductive member 4 or the like. However, the conductive member 4 of the embodiment described above does not have tips or projections at which the lumped discharge may occur, as shown in FIG. 2. Therefore, the discharge is not lumped at some part of the conductive member 4 and the sputtered fine particles do not deposit locally on a particular spot of the conductive member 4. Accordingly, the degradation in the dielectric strength and variation in performance of the conventional overvoltage protecting element due to the local deposition on the conductive member of the sputtered fine particles of the material constituting the electrodes may be prevented. The effective service life of the overvoltage protecting element is thus prolonged.

Figure 3:
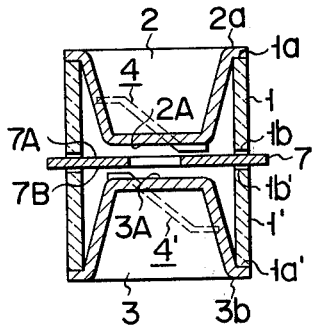
FIG. 3 is a schematic longitudinal sectional view showing the configuration of an overvoltage protecting element according to another embodiment of the present invention.

FIG. 3 is a schematic longitudinal sectional view showing the configuration of an overvoltage protecting element according to another embodiment of the present invention. The same reference numerals as in FIG. 1 denote the same parts, and the description thereof will be omitted. In the embodiment shown in FIG. 3, the present invention is applied to a 3-pole overvoltage protecting element. In addition to the hollow cylindrical body 1 and the main electrodes 2 and 3 same as in FIG. 1, a third electrode 7 is incorporated. This third electrode 7 defines two cylindrical bodies 1 and 1'. The main electrode 2 and the third electrode 7 are hermetically sealed to the opening ends 1*a* and 1*b* of the cylindrical body 1 in the same manner as in FIG. 1 so that discharging surfaces 2A and 7A of the main electrode 2 and the third electrode 7 may oppose each other with a gap therebetween. The main electrode 3 and the third electrode 7 are hermetically sealed to opening ends 1*a*' and 1*b*' of the cylindrical body 1' so that discharging surfaces 3A and 7B of the main electrode 3 and the third electrode 7 may oppose each other with a gap therebetween. In this manner, sealed chambers of 3-pole gas-filled discharge tube type are obtained. The conductive member 4, substantially the same as that shown in FIG. 1, extends along the inner wall surface of the cylindrical body 1 so that the conductive member 4 may oppose the main electrode 2 and the third electrode 7 with a gap therebetween. On the other hand, another conductive member 4' of substantially the same configuration extends along the inner wall surface of the cylindrical body 1' so that the conductive member 4' may oppose the main electrode 3 and the third electrode 7 with a gap therebetween. These conductive members 4 and 4' have a shape such as that shown in FIG. 2 as in the case of the conductive member 4 shown in FIG. 1. As in the case of the conductive member 4 shown in FIG. 1, these conductive members 4 and 4' form capacitors including gases as dielectric substances sealed in gas-filled discharge tubes between the main electrode 2 and the third electrode 7 and between the main electrode 3 and the third electrode 7, respectively, thereby establishing the capacitive coupling between the conductive members 4 and 4' and the electrodes 2, 3 and 7.

The mode of operation of the overvoltage protecting element of the embodiment as shown in FIG. 3 will now be described. The overvoltage protecting element shown in FIG. 3 is a 3-pole overvoltage protecting element and is equivalent to an integral combination of two overvoltage protective elements shown in FIG. 1. Therefore, the mode of operation of the overvoltage protecting element shown in FIG. 3 is substantially the same as the mode of operation described with reference to FIG. 1, and the detailed description thereof will thus be omitted. When the voltage surge is applied to the 3-pole overvoltage protecting element, as in the case of the overvoltage protecting element shown in FIG. 1, substantially uniform electric fields are induced between the main electrode 2 and the third electrode 7 and between the main electrode 3 and the third electrode 7. However, non-uniform electric fields are induced between the main electrode 2 and the conductive member 4, between the third electrode 7 and the conductive member 4, between the main electrode 3 and the conductive member 4', and between the third electrode 7 and the conductive layer 4'. Accordingly, the discharge between the main electrode 2 and the third electrode 7 and between the main electrode 3 and the third electrode 7 is facilitated, so that the lag in the initiating time of discharge in these discharge gaps may be effectively prevented as in the case of FIG. 1. The operation of the overvoltage protecting element, is also the same as described with reference to FIG. 1, when the particles of the material of the electrodes sputter upon repeated discharge operations in the discharge gap.

In the embodiments of the present invention described above, one conductive member 4 is interposed between the main electrodes 2 and 3 in the first embodiment shown in FIG. 1. The conductive elements 4 and 4' are respectively interposed between the main electrode 2 and the third electrode 7, and the main electrode 3 and the third electrode 7. However, the present invention is not limited to one conductive member. For example, one conductive member may be divided into a plurality of elongated pieces which are aligned substantially parallel to each other. Alternatively, two or more conductive members of the same shape may be incorporated symmetrically along the inner wall surface of the cylindrical body 1.

Figure 4:
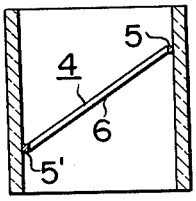
FIGS. 4 and 5 are schematic longitudinal sectional views showing the conductive member or members according to further embodiments of the present invention with the main electrodes being removed.
Figure 5:
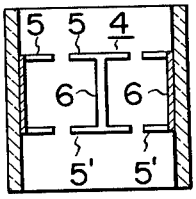

In the embodiments described above, the conductive member has a shape as shown in FIG. 2. However, the present invention is not limited to this. For example, the extended parts 5 and 5' shown in FIG. 4 may be extremely short, so that the conductive member 4 virtually comprises one obliquely oriented connecting part 6. Alternatively, the conductive member may be a plurality of I-shaped conductive members 4, 4' shown in FIG. 5 and so on. Therefore, the shape and the number of the conductive members may be freely selected as long as the conductive member includes a plurality of extended parts which extend along the inner wall surface of the cylindrical body in the circumferential direction thereof and a connecting part which extends along the inner wall surface of the cylindrical body to electrically connect the extended parts which are spaced apart from each other in the axial direction of the cylindrical body.

In order to form the conductive member along the inner wall surface of the cylindrical surface, it may be formed by drawing a graphite core, painting a conductive paint or the like. However, if the cylindrical body is made of glass or ceramics, it is preferable to chemically or mechanically roughen the inner wall surface of the cylindrical body and then form the conductive member thereafter. When the conductive member is formed in this manner, the conductive member tightly adheres to the roughened inner wall surface of the cylindrical body.

In order to form a conductive member by drawing using a graphite core, the width of the graphite core may be within the range of 0.2 to 1.0 mm. However, the greater the width of the core, the more variations are included in the local deposition of the conductive member on the inner wall surface of the cylindrical body. This leads to variations in the firing potential between the main electrodes. For this reason, the width of the graphite core for drawing is preferably within the range of 0.3 to 0.7 mm. The graphite core used in this case has great effects on the drawing performance. For example, when the hardness is great, the drawing may become discontinuous. On the other hand, when the hardness is smaller, the width of the drawn line varies. Therefore, the hardness of the graphite core must be selected so that these adverse effects are not notable.

In the manufacture of the overvoltage protecting element according to the present invention, the gap between the discharging surfaces of the main electrodes, and the minimum gap between the respective main electrodes and the conductive member are preferably selected in the manner to be described below:

An impulse wave firing potential VSS of the overvoltage protecting element may be kept substantially constant if the following relation is satisfied:

$$(g1+g2) \leqq G$$

where G is the gap between the discharging surfaces 2A and 3A of the main electrodes 2 and 3, g1 is the minimum gap between the main electrode 2 and the conductive member 4, and g2 is the minimum gap between the main electrode 3 and the conductive member 4.

A firing potential VS of the overvoltage protecting element may be kept substantially constant if the following relation is satisfied:

$$(g1+g2) \geqq G$$

Further, the impulse wave firing potential VSS and the firing potential VS may be kept substantially constant by suitably selecting the relationship between the sum (g1+g2) of the minimum gap g1 and the minimum gap g2 and the discharge gas G in the manner to be described below, depending upon whether a glow discharge voltage VD which is determined by the discharging surfaces 2A and 3A of the main electrodes 2 and 3 is high or low.

(i) If the glow discharge voltage VD is high, the following relation must be satisfied:

$$(g1+g2) \geqq G$$

(ii) If the glow discharge voltage in low, the following relation must be satisfied:

$$(g1+g2) \leqq G$$

The overvoltage protecting element of the present invention of the configuration as described above possesses the advantages to be described below:

(1) The conductive member does not have tips or projections which protrude into the discharge gap between the conductive member and the main electrodes, so that quite a large number of opposing discharging parts are obtained. This provides the same effects as obtainable when a number of drive electrodes for facilitating the discharge between the main electrodes are incorporated. The present invention thus provides an overvoltage protecting element having excellent firing potential characteristics.

(2) The discharge is not locally caused after discharge operations are repeated. Therefore, the degradation in the dielectric strength which is common in the prior art overvoltage protecting elements is significantly improved. The effective service life of the overvoltage protecting element of the present invention is thus vastly prolonged.

(3) In the prior art overvoltage protecting elements, the discharge tends to occur locally, and fine particles of the material of the main electrodes is deposited locally on the conductive member by sputtering after repeated discharge operations, resulting in variations in the firing potential. However, according to the present invention, the discharge does not occur locally, so that the variations in the firing potential may be effectively prevented.

(4) In the prior art overvoltage protecting element, the gap between the main electrodes and the conductive member must be carefully selected, or tips and projections must be formed on the conductive member, resulting in a large number of manufacturing steps. However, according to the present invention, selection of the gap or formation of tips or projections need not be considered, so that the manufacturing process of the overvoltage protecting element may be simplified.

What we claim is:

1. An overvoltage protecting element comprising a hollow cylindrical body of an insulating member; a pair of main electrodes which are hermetically sealed to both opening ends of said cylindrical body to define a sealed chamber therebetween and discharging surfaces of which oppose each other with a gap therebetween in said cylindrical body; and a conductive member having a plurality of extended parts and a connecting part, said extended parts extending along an inner wall surface of said cylindrical body in the circumferential direction thereof, to oppose said main electrodes with a gap therebetween, said extended parts being spaced apart from each other in the axial direction of said cylindrical body, and said connecting part extending along said inner wall surface to electrically connect said plurality of extended parts spaced apart in the axial direction of said cylindrical body.

2. An overvoltage protecting element comprising a first hollow cylindrical body of an insulator; a first main electrode hermetically sealed to one opening end of said first hollow cylindrical body; a second hollow cylindrical body of an insulator, one opening end of which is hermetically sealed to the other opening end of said first hollow cylindrical body; a second main electrode hermetically sealed to the other opening end of said second hollow cylindrical body; a third main electrode which is hermetically interposed between the other opening ends of said first hollow cylindrical body and said second hollow cylindrical body to define sealed chambers, and a discharging surface of which is opposed to discharging surfaces of said first and second main electrodes with a gap therebetween; and conductive bodies having a plurality of extended parts and connecting parts, said extended parts extending along inner wall surfaces of said first and second hollow cylindrical bodies in the circumferential direction thereof, to oppose said main electrodes with a gap therebetween, said extended parts being spaced apart from each other in the axial direction of said first and second hollow cylindrical bodies, and said connecting parts extending along said inner wall surface to electrically connect said plurality of extended parts spaced apart in the axial direction of said first and second cylindrical bodies.

3. An overvoltage protecting element according to claim 1 or 2, wherein not less than two conductive members of the same shape are symmetrically arranged along said inner wall surface of said cylindrical body.

4. An overvoltage protecting element according to claim 1 or 2, wherein said conductive member is formed by applying or depositing a conductive material such as graphite on said inner wall surface of said cylindrical body.

5. An overvoltage protecting element according to claim 1 or 2, wherein said conductive member is formed in a linear form using a graphite core having a width of 0.3 to 0.7 mm.

6. An overvoltage protecting element according to claim 1 or 2, wherein, if a glow discharge voltage between said discharge surfaces is high, relation $(g1+g2) \geqq G$ is satisfied wherein g1 is a minimum gap between one of said main electrodes and said conductive member, g2 is a minimum gap between the other of said main electrodes and said conductive member, and G is a gap between said discharging surfaces of said main electrodes.

7. An overvoltage protecting element according to claim 1 or 2, wherein, if a glow discharge voltage between said discharge surfaces is low, relation $(g1+g2) \leqq G$ is satisfied wherein g1 is a minimum gap between one of said main electrodes and said conductive member, g2 is a minimum gap between the other of said main electrodes and said conductive member, and G is a gap between said discharging surfaces of said main electrodes.

* * * * *